US012037729B2

(12) United States Patent
Rodrigues Ferrari et al.

(10) Patent No.: US 12,037,729 B2
(45) Date of Patent: Jul. 16, 2024

(54) LAUNDRY TREATING APPLIANCE

(71) Applicant: WHIRLPOOL CORPORATION, Benton Harbor, MI (US)

(72) Inventors: Caio Cesar Rodrigues Ferrari, Stevensville, MI (US); Arthur V. Tosini, Sao Paulo (BR)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 17/887,972

(22) Filed: Aug. 15, 2022

(65) Prior Publication Data

US 2024/0052541 A1 Feb. 15, 2024

(51) Int. Cl.

| | |
|---|---|
| ***D06F 33/32*** | (2020.01) |
| *D06F 103/18* | (2020.01) |
| *D06F 103/24* | (2020.01) |
| *D06F 103/46* | (2020.01) |
| *D06F 105/48* | (2020.01) |

(52) U.S. Cl.

CPC ..... *D06F 33/32* (2020.02); *D06F 2103/18* (2020.02); *D06F 2103/24* (2020.02); *D06F 2103/46* (2020.02); *D06F 2105/48* (2020.02)

(58) Field of Classification Search

CPC .. D06F 33/32; D06F 2103/18; D06F 2103/24; D06F 2103/46; D06F 2105/48

See application file for complete search history.

(56) References Cited

U.S. PATENT DOCUMENTS

| | | | | |
|---|---|---|---|---|
| 4,642,536 | A * | 2/1987 | Boyd, Jr. | D06F 34/08 318/400.1 |
| 4,972,134 | A | 11/1990 | Getz et al. | |
| 5,271,116 | A * | 12/1993 | Williams | D06F 34/18 8/159 |
| 5,398,298 | A * | 3/1995 | Ensor | D06F 34/08 318/400.4 |
| 5,734,289 | A | 3/1998 | Khudoshin | |
| 2003/0025395 | A1* | 2/2003 | Peterson | D06F 35/007 307/11 |
| 2008/0120790 | A1 | 5/2008 | Ashrafzadeh et al. | |
| 2008/0303463 | A1* | 12/2008 | Darby | H02P 6/22 68/12.16 |
| 2013/0009587 | A1 | 1/2013 | Yabuguchi et al. | |
| 2013/0152311 | A1 | 6/2013 | Janke et al. | |
| 2013/0160219 | A1 | 6/2013 | Ashrafzadeh et al. | |

(Continued)

*Primary Examiner* — Joseph L. Perrin

(74) *Attorney, Agent, or Firm* — McGarry Bair PC

(57) ABSTRACT

A laundry treating appliance includes a clothes mover coupled to a motor, and a controller arranged to control the motor. The controller determines a respective value of a first parameter and a second parameter, and compares the determined values with predetermined respective threshold values. Based on the comparing, the controller selects a motor actuation sequence comprising a first power cycle having a first ON period and first OFF period, and a second power cycle having a second ON period and second OFF period. Each first and second ON period includes providing power to the motor for a respective first and third duration, and each first and second OFF period includes cutting off power to the motor for a respective second and fourth duration. The controller controls a speed of rotation of the clothes mover by triggering the first power cycle and a second power cycle to the motor.

10 Claims, 6 Drawing Sheets

(56) References Cited

U.S. PATENT DOCUMENTS

| | | | | |
|---|---|---|---|---|
| 2013/0160220 | A1 | 6/2013 | Ashrafzadeh et al. | |
| 2015/0204003 | A1* | 7/2015 | Kim | D06F 33/30 318/452 |
| 2016/0281288 | A1 | 9/2016 | Cabra | |
| 2016/0312395 | A1 | 10/2016 | Driussi et al. | |
| 2017/0145614 | A1 | 5/2017 | Janke et al. | |
| 2017/0145617 | A1 | 5/2017 | Sumer | |
| 2017/0233924 | A1* | 8/2017 | Ihne | D06F 33/32 8/137 |

* cited by examiner

LAUNDRY TREATING APPLIANCE

BACKGROUND

Laundry treating appliances, such as washing machines, combination washer/dryers, condensing dryers, refreshers, and non-aqueous systems, can have a configuration based on a rotating laundry basket or drum that defines a drum opening and at least partially defines a treating chamber in which laundry items are placed for treating. The drum can be provided within an interior of a tub that defines a tub opening and further can at least partially define the treating chamber. The laundry treating appliance can have a controller that implements a number of user-selectable, pre-programmed cycles of operation having one or more operating parameters.

Conventional laundry treating appliances are provided with an electrically powered drive motor, which is used to drive a cylindrical perforate basket during a spin cycle, and a clothes mover during wash and rinse cycles for agitating the laundry load within the basket. Typical laundry treating appliances include a controller that is programmed to maximize cleaning efficiency while minimizing water and power consumption. Conventional laundry treating appliances can thus provide a multitude of options for matching a selected cleaning operation to the type of fabric comprising the laundry load and the degree of soiling of the laundry load.

BRIEF SUMMARY

In one aspect, the present disclosure relates to a laundry treating appliance a drum at least partially defining a treating chamber for receiving a laundry load; a clothes mover disposed in the drum rotatably coupled to a drive motor; and a controller including a memory, communicatively coupled to the drive motor to selectively control an operation thereof, the controller configured to: determine a first value of a first parameter and a second value of a second parameter associated with the laundry treating appliance; compare the first value and the second value with a predetermined respective threshold value; and, based on the comparing: select a predefined drive motor actuation sequence comprising a first power cycle and a second power cycle, the first power cycle comprising a first ON period and a first OFF period, and the second power cycle comprising a second ON period and a second OFF period, and wherein each first and second ON period includes providing electrical power to a first winding of the drive motor for a respective predefined first and third duration, and each first and second OFF period includes cutting off electrical power to the first winding for a respective predefined second and fourth duration; and control a speed of rotation of the clothes mover in a first direction about a vertical axis by triggering the first power cycle and a second power cycle to the first winding.

In another aspect, the present disclosure relates to method of operating a laundry treating appliance, the appliance having a drum at least partially defining a treating chamber for receiving a laundry load, a clothes mover disposed in the drum rotatably coupled to a drive motor. The method comprises determining, with a controller, a first value of a first parameter and a second value of a second parameter associated with the laundry treating appliance; comparing the first value and the second value with a predetermined respective threshold value; and, based on the comparing: selecting a predefined drive motor actuation sequence comprising a first power cycle and a second power cycle, the first power cycle comprising a first ON period and a first OFF period, and the second power cycle comprising a second ON period and a second OFF period, and wherein each first and second ON period includes providing electrical power to a first winding of the drive motor for a respective predefined first and third duration, and each first and second OFF period includes cutting off electrical power to the first winding for a respective predefined second and fourth duration; and controlling a speed of rotation of the clothes mover in a first direction about a vertical axis, wherein the controlling includes sequentially triggering the first power cycle and the second power cycle to the first winding.

DETAILED DESCRIPTION

Conventional laundry treating appliances are typically provided with an electrically powered motor, which can be used to drive a cylindrical perforate basket during a spin cycle, and a clothes mover (e.g., an agitator) rotatably disposed in the basket during wash and rinse cycles for agitating a laundry load within the basket. The laundry load can include clothing items, water, and soap or other chemicals. Such conventional laundry treating appliances can provide a multitude of options for matching a selected cleaning operation to the type of fabric comprising the laundry load and the degree of soiling of the laundry load. For example, a conventional clothes washer often includes a controller that is programmed to selectively provide power to operate the motor to rotate the basket, or the clothes mover, or both, at predetermined speeds based on, for example, the laundry load and the degree of soiling of the laundry load. Typically, when the clothes mover rotates (e.g., during an agitation phase) the laundry load in the basket can rotate with the basket such that a distributed mass of the laundry load within the basket contributes to the inertia of the rotating basket or clothes mover or both.

Conventional laundry treating appliances often employ a permanent split capacitor (PSC) type motor. The PSC motor can be operative to drive the clothes mover in an oscillating manner, first in a forward (e.g., clockwise) or first direction, then in a backward (e.g., counterclockwise) or second direction. The motor can be powered by an alternating current (AC) power source. The motor can include a pair of windings connected such that one winding can be selectively energized to rotate the motor in the first direction, and the other winding can be selectively energized to operate the motor in the second direction. Typically, a respective triac is coupled in series between each winding and the AC power source to selectively energize the windings. The triacs are triggered via a respective gate signal at a predetermined phase angle of the AC waveform.

Figure 1A:
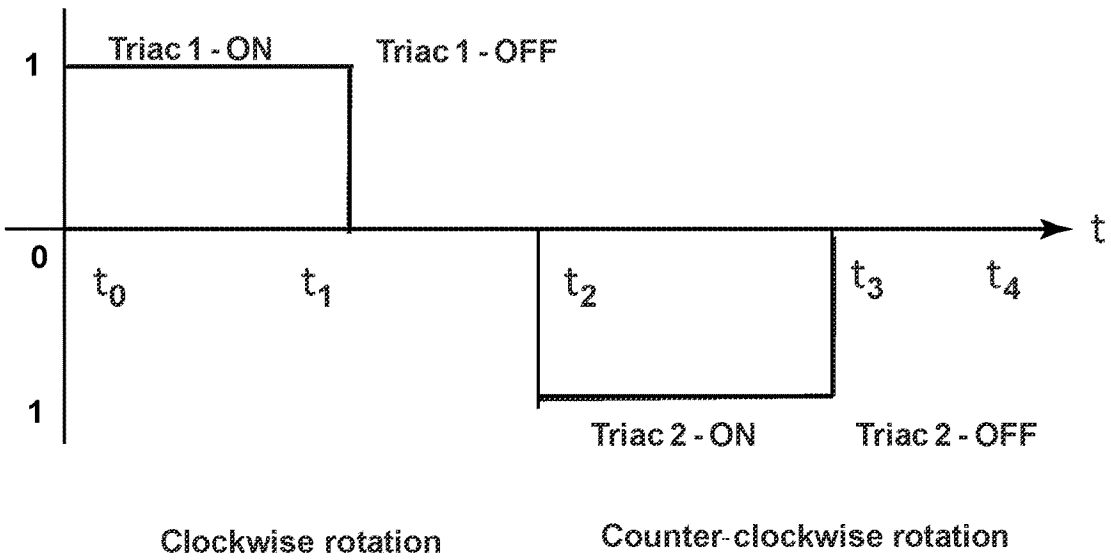
FIG. 1A (Prior Art)
FIG. 1A illustrates a typical energization sequence with respect to time for a conventional laundry treating appliance motor.

By way of illustration, FIG. 1A depicts a typical energization sequence with respect to time (t) for a conventional laundry treating appliance motor to cause an oscillating operation the clothes mover via the motor. As shown, a triac ("triac 1"), coupled in series between a first winding of the motor and the AC power source, can be triggered (at $t=t_0$) by the controller to transition from an "OFF" or non-conducting state to an "ON" or conducting state. In the ON state, triac 1 will operatively provide AC power to a respective motor winding to trigger a clockwise rotation of the motor. After a fixed predetermined time period (e.g., 800 milliseconds), the gate signal to triac 1 can be cut off (at $t=t_1$), transitioning the triac 1 from the ON state to the OFF state, thereby deenergizing the motor. Next, after another fixed predetermined period of time, another triac ("triac 2"), coupled in series between a second winding of the motor and the AC power source, can likewise be triggered (at $t=t_2$) by the controller to transition from an OFF state to an ON state. In the ON state, triac 2 will operatively provide AC power to the motor to energize another respective motor winding and thereby trigger a counter-clockwise rotation of the motor. After a fixed predetermined time period (e.g., 800 milliseconds), the gate signal to triac 2 can be cut off (at $t=t_3$), thereby deenergizing the motor. If desired, the sequence can be repeated to continue operating the motor in an oscillating manner.

Typically, the controller is arranged to energize the motor windings via the respective triacs to obtain predetermined velocity profile of the drive motor. For example, conventional controllers are configured continuously energize the motor windings to accelerate the drive motor (i.e., a ramp-up phase) without interruption until a predetermined constant velocity is reached, then operate or run the motor at a predetermined constant velocity (i.e., a steady-state phase) for a predetermined period of time, and then finally cut off power to the motor windings to decelerate the motor (i.e., a ramp-down phase) until the motor reaches a zero velocity. If desired, the drive motor can then be operated in the reverse direction in a likewise manner.

Figure 1B:
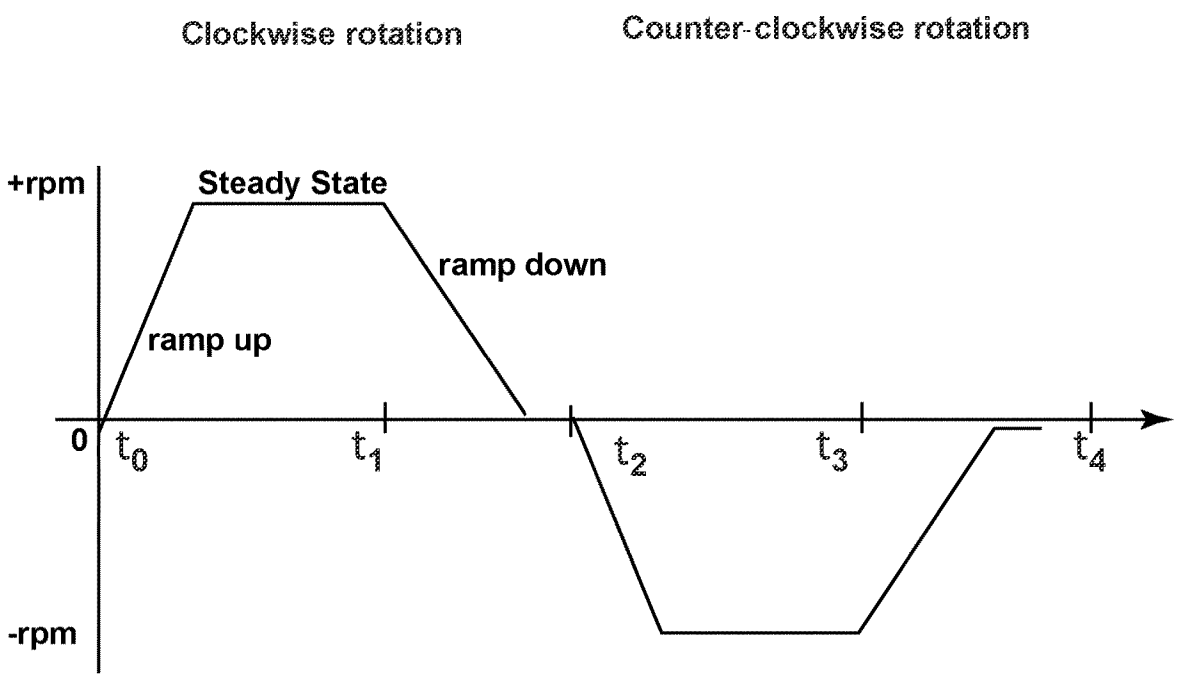
FIG. 1B (Prior Art)
FIG. 1B a typical velocity profile with respect to time for a conventional laundry treating appliance motor having the energization sequence of FIG. 1A.

By way of illustration, FIG. 1B, depicts a typical velocity profile with respect to time (t) for a conventional laundry treating appliance motor based on the typical energization sequence depicted in FIG. 1A. As shown, when the controller triggers "triac 1" at $t=t_0$ to energize the motor to have a clockwise rotation, the motor, starting from an initial velocity of zero revolutions per minute (rpm), begins continuously accelerating clockwise during the motor speed ramp-up phase without interruption. Once the motor reaches the predetermined velocity, it continues to rotate clockwise at the predetermined constant velocity during the steady-state phase. The motor will continue to rotate at the fixed steady-state velocity without interruption for the fixed predetermined time period (e.g., 800 milliseconds) until the controller cuts off the gate signal to triac 1 at t=1, thereby deenergizing the motor. However, the deenergized motor will continue to rotate clockwise, based on inertia, during the deceleration or ramp down phase. The duration of the ramp-down phase will vary at least in part with the inertia of the motor and laundry load. Next, after a fixed predetermined period of time, the other triac ("triac 2") can be triggered at t=t2 to energize the motor to have a counter-clockwise rotation. The motor, starting from an initial velocity of zero rpm, begins accelerating counter-clockwise without interruption during the motor speed ramp-up phase. Once the motor reaches its desired or predetermined velocity, it continues to rotate counter-clockwise during the steady state-phase. The motor will continue to rotate at the fixed steady-state velocity without interruption for the fixed predetermined time period (e.g., 800 milliseconds) until the gate signal to triac 2 is cut off at $t=t_3$, thereby deenergizing the motor. The deenergized motor will continue to rotate based on inertia, during a deceleration or ramp down phase until the motor reaches a zero velocity.

It is desirable to control the power to the motor to maximize cleaning efficiency while minimizing water and power consumption, with minimal operating noise. In some cases, the power to the drive motor can be controlled based at least in part on the inertia of the rotating system. However, in many cases, determining inertia during operation can require various torque and velocity sensors as well as additional calculations by the controller, contributing to additional cost and complexity. It would be advantageous therefor to control the power to the drive motor to maximize cleaning efficiency while minimizing water and power consumption, and reducing operating noise based on operating parameters readily measured without need to directly determine inertia during operation. However, it is often undesirable to controlling the power to the drive motor by ceasing or reducing power to the drive motor, because it can create an appearance or perception by a user of a reduction of velocity or a discontinuity in the motion of the clothes mover, which can cause the user to incorrectly perceive a problem or malfunction has occurred with the drive motor. It would further be advantageous therefor to control the power to the drive motor to maximize cleaning efficiency while minimizing water and power consumption, and reducing operating noise, while reducing or eliminating the perception of a reduction of speed or stop in the motion of the clothes mover.

In describing aspects illustrated in the drawings, specific terminology will be resorted to for the sake of clarity. However, it is not intended that the aspects be limited to the specific terms so selected and it is to be understood that each specific term includes all technical equivalents that operate in a similar manner to accomplish a similar purpose. For example, the words "connected," "attached," "coupled," and "mounted" and variations thereof herein are used broadly and encompass direct and indirect connections, attachments, couplings, and mountings. In addition, the terms "connected," "coupled," etc. and variations thereof are not restricted to physical or mechanical connections, couplings, etc. as all such types of connections should be recognized as being equivalent by those skilled in the art.

As used herein, the term "set" or a "set" of elements can be any non-zero number of elements, including only one. The exemplary drawings are for purposes of illustration only and the dimensions, positions, order and relative sizes reflected in the drawings attached hereto can vary.

Additionally, as used herein, a "processor", or "controller" can include a component configured or adapted to provide instruction, control, operation, or any form of communication for operable components to affect the operation thereof. A processor or controller can include any known processor, microcontroller, or logic device, including, but not limited to: Field Programmable Gate Arrays (FPGA), an Application Specific Integrated circuit (ASIC), a Proportional controller (P), a Proportional Integral controller (PI), a Proportional Derivative controller (PD), a Proportional Integral Derivative controller (PID controller), a hardware-accelerated logic controller (e.g. for encoding, decoding, transcoding, etc.), the like, or a combination thereof. Non-limiting examples of a controller can be configured or adapted to run, operate, or otherwise execute program code to effect operational or functional outcomes, including carrying out various methods, functionality, processing tasks, calculations, comparisons, sensing or measuring of values, or the like, to enable or achieve the technical operations or operations described herein. The operation or functional outcomes can be based one or more inputs, stored data values, sensed or measured values, true or false indications, or the like. While "program code" is described, non-limiting examples of operable or executable instruction sets can include routines, programs, objects, components, data structures, algorithms, etc., that have the technical effect of performing particular tasks or implement particular abstract data types. In another non-limiting example, a processor or controller can also include a data storage component accessible by the processor, including memory, whether transient, volatile or non-transient, or non-volatile memory.

Additional non-limiting examples of the memory can include Random Access Memory (RAM), Read-Only Memory (ROM), flash memory, or one or more different types of portable electronic memory, such as discs, DVDs, CD-ROMs, flash drives, universal serial bus (USB) drives, the like, or any suitable combination of these types of memory. In one example, the program code can be stored within the memory in a machine-readable format accessible by the processor. Additionally, the memory can store various data, data types, sensed or measured data values, inputs, generated or processed data, or the like, accessible by the processor in providing instruction, control, or operation to affect a functional or operable outcome, as described herein. In another non-limiting example, a controller can include comparing a first value with a second value, and operating or controlling operations of additional components based on the satisfying of that comparison. For example, when a sensed, measured, or provided value is compared with another value, including a stored or predetermined value, the satisfaction of that comparison can result in actions, functions, or operations controllable by the controller. As used herein, the term "satisfies" or "satisfaction" of the comparison is used herein to mean that the first value satisfies the second value, such as being equal to or less than the second value, or being within a predetermined value range of the second value. It will be understood that such a determination may easily be altered to be satisfied by a positive/negative comparison or a true/false comparison. Example comparisons can include comparing a sensed or measured value to a threshold value or threshold value range.

Aspects of the disclosed systems and methods may be implemented in hardware, firmware, software, or any combination thereof. Aspects of the disclosed systems and methods implemented in a laundry treating appliance may include one or more point-to-point interconnects between components and/or one or more bus-based interconnects between components. Aspects can also be implemented as instructions stored one or more non-transitory, machine-readable media, which may be read and executed by an electronic controller. A non-transitory, machine-readable medium may include any mechanism for storing or transmitting information in a form readable by a machine (e.g., a processor). For example, non-transitory, machine-readable media may include read only memory (ROM), random access memory (RAM), magnetic disk storage, optical storage, flash memory, and/or other types of memory devices.

The term "horizontal axis" is often used as shorthand term for the manner in which a conventional laundry treating appliances imparts mechanical energy to the laundry load, even when the relevant rotational axis is not absolutely vertical. As used herein, the "vertical axis" laundry treating appliance refers to a laundry treating appliance having a rotatable drum, perforate or imperforate, that holds fabric items and, a clothes mover, such as an agitator, impeller, nutator, and the like within the drum. The clothes mover can move within the drum to impart mechanical energy directly to the clothes or indirectly through wash liquid in the drum. The clothes mover can be moved in a reciprocating rotational movement. In some vertical axis laundry treating appliances, the drum and clothes mover rotate about a vertical axis generally perpendicular to a surface that supports the laundry treating appliance. However, the rotational axis need not be vertical. The drum and clothes mover can rotate about an axis inclined relative to the vertical axis.

Figure 2:
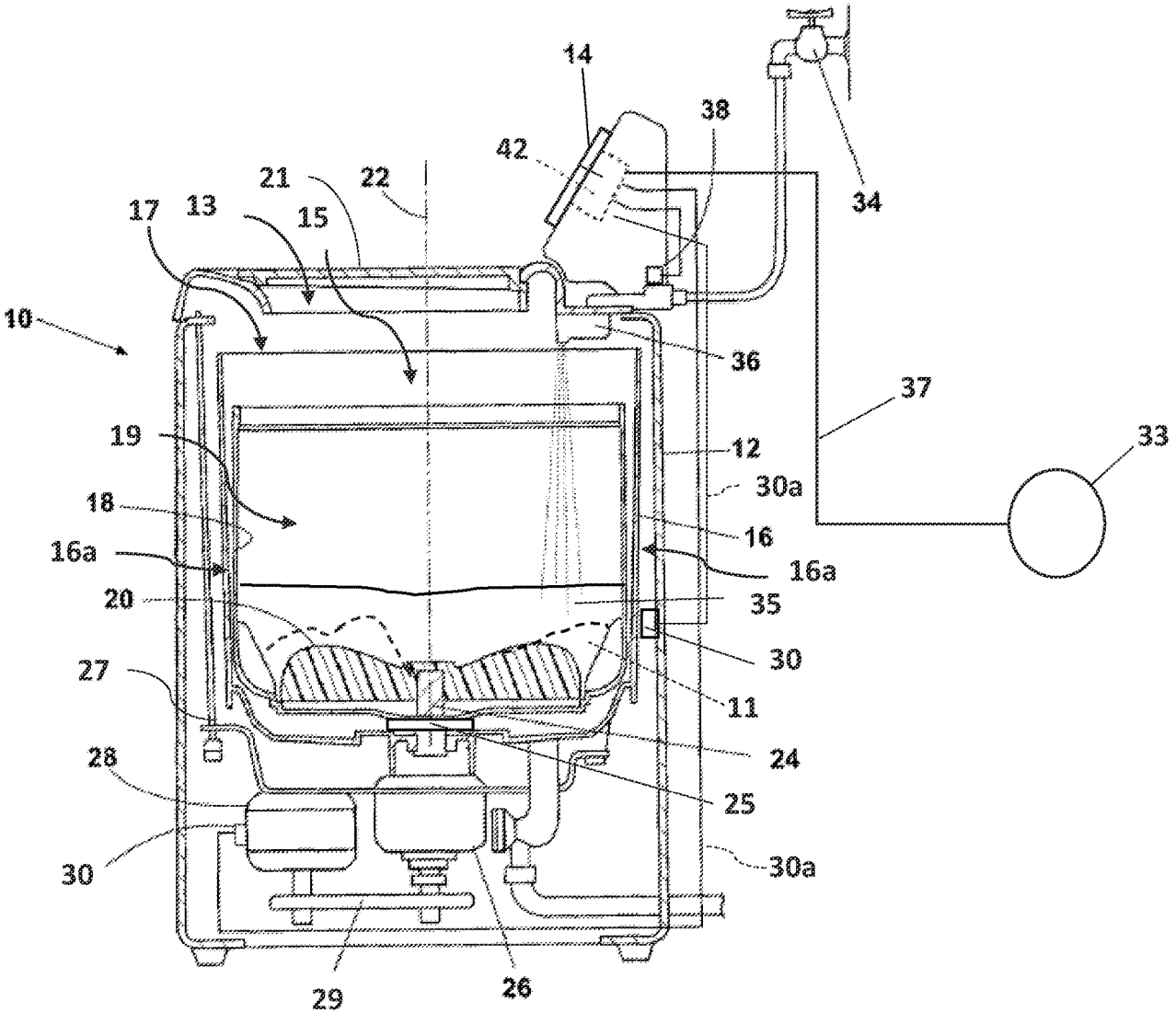
FIG. 2 illustrates a partially cut away elevational view of a laundry treating appliances in accordance with a non-limiting aspect of the present disclosure.

FIG. 2 is a schematic cross-sectional view of a laundry treating appliance 10 according to an aspect of the present disclosure. The laundry treating appliance 10 can be any laundry treating appliance 10 which performs a cycle of operation to clean or otherwise treat laundry items placed therein. While the laundry treating appliance 10 is illustrated herein as a vertical axis, top-load laundry treating appliance 10, the aspects of the present disclosure can have applicability in laundry treating appliances with other configurations.

The laundry treating appliance 10 can comprise a structural support assembly comprising a cabinet 12 which defines a housing with an interior. The cabinet 12 includes a top surface that at least partially defines a laundry loading opening 13 for the laundry treating appliance 10. The cabinet 12 can be a housing defining a chassis and/or a frame, to which decorative panels (not shown) can or cannot be mounted, defining the interior, enclosing components typically found in a conventional laundry treating appliance, such as motors, pumps, fluid lines, controls, sensors, transducers, and the like. Such components will not be described further herein except as necessary for a complete understanding of the present disclosure.

The laundry treating appliance 10 can include a door assembly 21, a user interface 14, a liquid-tight tub 16, a rotatable drum 18, a treating chamber 19 a clothes mover 20, a drive motor 28, a set of sensors 30, and a controller 42. The laundry treating appliance 10 can be coupled to an electrical power source 39 (e.g., an AC power outlet) via a set of power lines 37 to receive electrical power therefrom. The laundry treating appliance 10 can also be connected to a water source 34 which can be delivered to the tub 16 through a nozzle 36 controlled by a valve 38 operably coupled to the controller 42.

The user interface 14 can be communicatively coupled to the controller 42. In non-limiting aspects, the user interface 14 can be arranged on the cabinet 12. In some aspects, the user interface can be disposed remote from the laundry treating appliance 10. The user interface 14 can include one or more knobs, dials, switches, displays, touch screens, and the like for communicating with the user, such as to receive data input and provide data output. For example, the displays can include any suitable communication technology including that of a liquid crystal display (LCD), a light-emitting diode (LED) array, or any suitable display that can convey a message to the user. The user can enter different types of information including, without limitation, cycle selection and cycle parameters, such as cycle options. Other communications paths and methods, with or without the user interface 14, can also be included in the laundry treating appliance 10 and can allow the controller 42 to communicate with the user in a variety of ways. For example, the controller 42 can be configured to send a text message to the user, send an electronic mail to the user, or provide audio information to the user either through the laundry treating appliance 10 or utilizing another device such as a mobile phone.

The tub 16 can be dynamically suspended within an interior of the cabinet 12 by a suitable suspension assembly 27. The tub 16 can at least partially define the treating chamber 19 for laundry items. The tub 16 includes a tub opening 17 through which the treating chamber 19 is accessible. The tub opening 17 can be at least partially aligned with the laundry loading opening 13. The rotatable drum 18 can define a drum opening 15. The drum 18 can be provided within the tub 16 to define at least a portion of the treating chamber 19. The drum opening 15 can be at least partially aligned with at least one of the tub opening 17 and the laundry loading opening 13. The treating chamber 19 is configured to receive a laundry load 11 such as clothing articles for treatment. The laundry load 11 can also include water 35 received from the water source 34. In non-limiting aspects, the drum 18 can define a set of perforations 18*a* therethrough such that liquid (e.g., water 35) can flow between the tub 16 and the drum 18 through the perforations 18*a*. It is contemplated that in some non-limiting aspects the laundry treating appliance 10 can comprise only one receptacle, such as the tub 16 without the drum 18, or the drum 18 without the tub 16, with the single receptacle defining the treating chamber 19 for receiving the load to be treated.

The laundry treating appliance 10 can further include a closure, illustrated herein as the door assembly 21, which can be movably mounted to or coupled to the cabinet 12, such as to the top surface of the cabinet 12, to selectively close both the tub 16 and the drum 18, as well as the laundry loading opening 13, the tub opening 17, the drum opening 15, and the treating chamber 19. In one example, the door assembly 21 can be rotatable relative to the cabinet 12. By way of non-limiting example, the door assembly 21 can be hingedly coupled to the cabinet 12 for movement between an opened condition (not shown), wherein access is provided to the treating chamber 19 through the laundry loading opening 13 and the tub opening 17, and a closed condition as shown to selectively open and close the laundry loading opening 13.

The clothes mover 20 (e.g., an agitator) can be rotatably disposed in the bottom of the drum 18 and adapted to rotate about an oscillation axis 22 (e.g., a vertical axis) to impart movement to the laundry load 11 removeably placed within the drum 18 by a user for treatment. In non-limiting aspects, the clothes mover 20 can be operably driven by the drive motor 28 through an optional transmission 26 and drive belt 29. In other non-limiting aspects, the drive motor 28 can instead be directly coupled via a drive shaft (not shown) to the clothes mover 20 without need of the 26 transmission or drive belt 29 (e.g., a direct-drive arrangement). In non-limiting aspects, a shifter 25 can selectively rotatably couple the drum 18, or the clothes mover 20, or both to the drive motor 28. In some aspects, the laundry treating appliance 10 can include a number of pulleys and belts or a gear assembly (not shown) configured to translate a rotary motion of the drive motor 28 into a rotational movement of the clothes mover 20, or drum 18, or both.

The set of sensors 30 can be disposed in various locations within the laundry treating appliance 10 and communicatively coupled to the controller 42. The set of sensors 30 can configured to detect, measure, or otherwise sense a respective parameter 60. In non-limiting aspects, the controller 42 can be configured to determine the value of at least one respective parameter 60 based one or more received signal 30*a*. In non-limiting aspects, the at least one respective parameter 60 can include a first parameter 63 and a second parameter 64. Each sensor 30 can be arranged to provide a respective signal 30*a* to the controller 42 indicative of a value of the respective parameter 60. The value of the respective parameter 60 can be, directly or indirectly, at least partially indicative of an inertia of the drive motor 28. In non-limiting aspects, the respective parameters 60 can include, without limitation, a voltage across a winding of the drive motor 28, an amount of water in the drum 18, a rotational velocity of the drive motor 28, a weight of the laundry load 11, and the like. The sensors 30 can comprise any desired conventional sensor type including, but not limited to, a voltage sensor, a current sensor, a temperature sensor, water level sensor, a weight sensor, a torque sensor, a speed sensor, a humidity sensor, a pressure sensor, a light sensor, a photo-electric sensor, a proximity sensor, a chemical sensor, a moisture sensor, an airflow sensor, a switch sensor, or combinations thereof.

The controller 42 can be communicatively coupled to the user interface 14 and the set of sensors 30. For example, the controller 42 can receive the signals 30*a* indicative of the value of a respective parameter 60. In non-limiting aspects, the controller 42 can be configured to determine the value of at least one respective parameter 60 based one or more received signal 30*a*. As will be described in more detail herein, the controller 42 can be configured to, based at least in part on the signals 30*a* received from the sensors 30, selectively activate or energize electronically-controlled components of the laundry treating appliance 10, such as the drive motor 28. For example, the controller 42 can be configured to control the various components of the laundry treating appliance 10 according to a selected predefined cycle program or in accordance with predefined operating parameters. In non-limiting aspects, controller 42 is communicatively coupled to the drive motor 28 to control an operation thereof based at least in part on the determined values of the respective parameters 60.

In non-limiting aspects, the drive motor 28 can be a permanent split capacitor (PSC) motor having a low start torque relative to its breakdown torque to provide a soft start of the clothes mover 20. In non-limiting aspects, the drive motor 28 can have a relatively flat load curve above a breakdown point so that its steady-state speed will not vary greatly with load. In non-limiting aspects, the drive motor 28 can be a high slip type motor. The drive motor 28 can be mounted in a bracket arrangement (not shown) supportably coupled to the to the cabinet 12.

While the clothes mover 20 is illustrated in FIG. 2 as a low-profile vertical-axis impeller, other aspects are not so limited. For example, in other non-limiting aspects, the clothes mover 20 can be a vertical axis agitator, with or without an auger, or a basket adapted with peripheral vanes. The clothes mover 20 and drum 18 can be coaxially aligned with respect to a vertically oriented oscillation axis 22. Furthermore, while aspects as described herein will be described and illustrated for ease of understanding with respect to a low-profile impeller, other clothes movers can be utilized without departing from the scope of the invention. For example, it is contemplated aspects can be adapted to horizontal axis washers as well as to the vertical axis washers.

Figure 3:
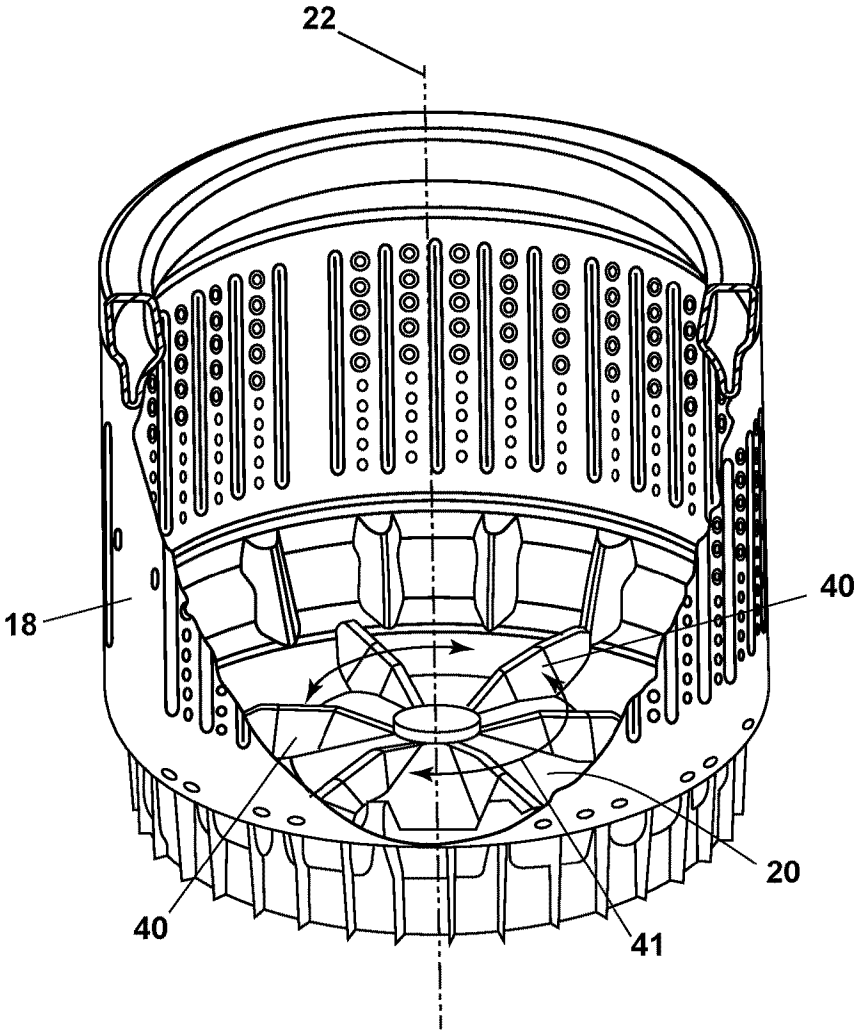
FIG. 3 is a partially cutaway perspective view of the drum and clothes mover illustrated in FIG. 2.

FIG. 3 illustrates the drum 18 and the clothes mover 20 in coaxial alignment with the oscillation axis 22. In non-limiting aspects, the drum 18 can be cylindrical, and can be formed from metallic materials, such as, for example, steel, or from polymeric materials, such as, for example, a rigid plastic resin. In non-limiting aspects, the clothes mover 20 can be a circular, platelike body having a set of radially disposed vanes 40 extending upwardly therefrom. In other non-limiting aspect, the clothes mover 20 can have any desired structure as known in the art without departing from the scope of the disclosure herein. The vanes 40 can be adapted to contact and interact with fabric items and liquid (omitted for clarity) in the drum 18 for agitating the fabric items and the liquid. During an operation of the laundry treating appliance 10 (e.g., a wash cycle or a rinse cycle), the clothes mover 20 can be driven by the drive motor 28 (not shown) for movement within the treating chamber 19. In non-limiting aspects, the drum 18 can be braked to remain stationary during a rotation of the clothes mover 20. In other non-limiting aspects, the drum 18 can be arranged to freely rotate during the rotation of the clothes mover 20.

As indicated by the arrow 41, the drive motor 28 can drive or rotate the clothes mover 20 in an oscillating manner, first in a forward (e.g., clockwise) or first direction, then in a backward (e.g., counterclockwise) or second direction. The clothes mover 20 can rotate in the first direction through a preselected angular displacement, for example, ranging from 180° to 720°. The clothes mover 20 can rotate in the second direction through a similar preselected angular displacement. Additionally, water 35, and multiple fabric items, which collectively form at least a portion of the laundry load 11 (not shown), can be placed or disposed in the drum 18 by a user. Some of the fabric items will be in direct contact with the clothes mover 20 and some will not. As the clothes mover 20 moves, mechanical energy is imparted to the laundry load 11.

Figure 4:
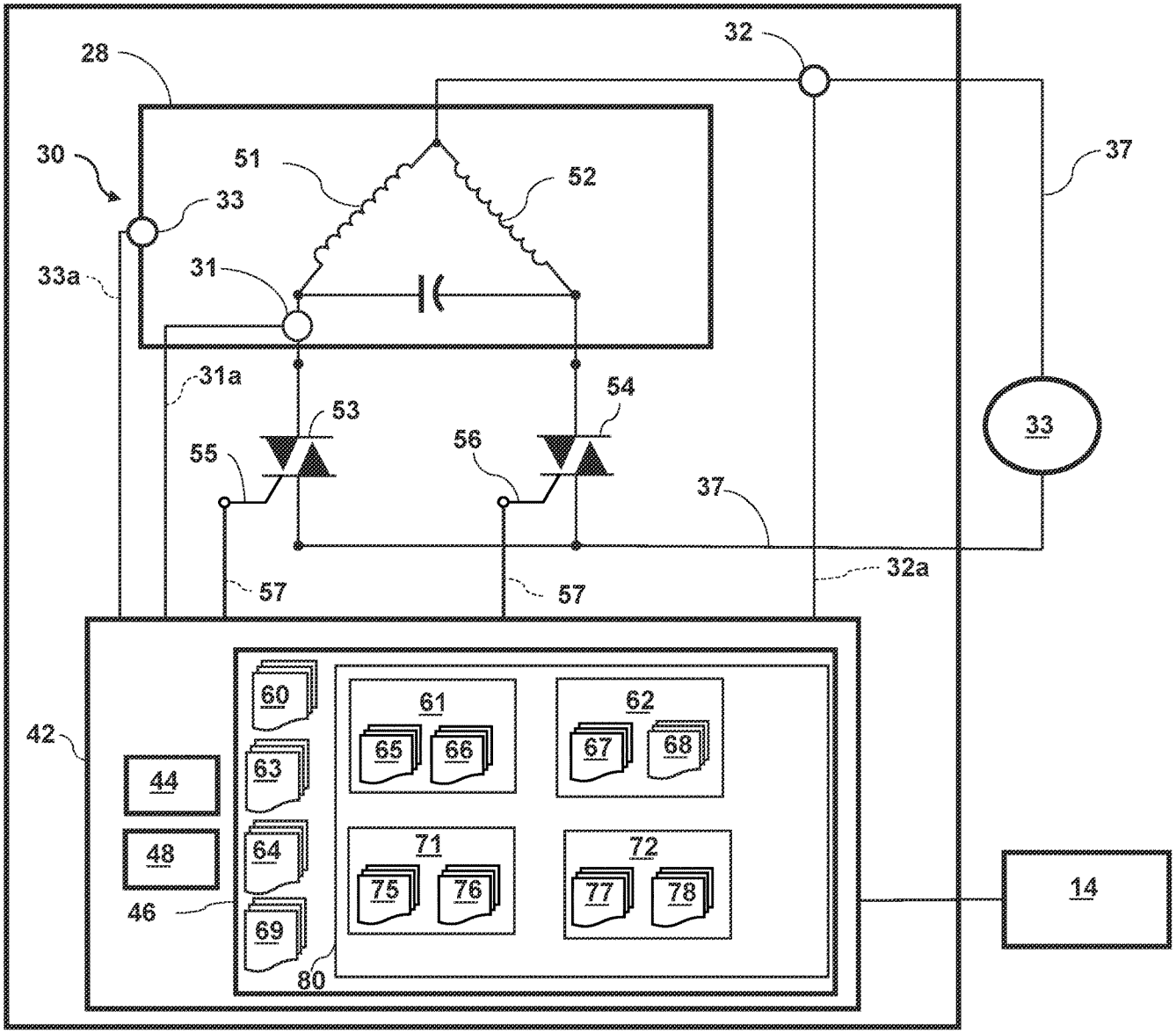
FIG. 4 is a simplified schematic representation of a non-limiting aspect of the laundry treating appliance of FIG. 2.

FIG. 4 illustrates a simplified schematic representation of a non-limiting aspect of the laundry treating appliance 10, with some parts omitted for clarity. The controller 42 is shown communicatively coupled to the user interface 14 and the set of sensors 30. The controller 42 can be further communicatively coupled to the drive motor 28 via a first switch 53 and a second switch 54. In non-limiting aspects, the drive motor 28 can include a first winding 51 and a second winding 52. The drive motor 28 can be electrically coupled to the electrical power source 39 (shown as an AC power source) via the set of power lines 37. In non-limiting aspects, one of the power lines 37 can define a neutral line. The controller 42 can include a number of electronic components commonly associated with electronic units utilized in the control of electromechanical systems. For example, the controller 42 can include, a processor such as a central processing unit (CPU) 44, a memory 46, and an analog interface circuit 48.

The first switch 53 and second switch 54 can be coupled electrically in series between the electrical power source 39 and the first winding 51 and second winding 52, respectively. As shown, in non-limiting aspects, the first switch 53 can comprise a first triac 53 the second switch 54 can comprise a second triac 54. The first triac 53 can include a first control electrode 55, and the second triac 54 can include a second control electrode 56. The first control electrode 55 and second control electrode 56 can be coupled in in signal communication with the controller 42, to selectively receive a respective gate signal 57 therefrom.

In non-limiting aspects, the set of sensors 30 can include a current sensor 31 electrically coupled to the drive motor 28. The current sensor 31 can be configured to generate a signal 31*a* indicative of the electrical current supplied by the electrical power source 39 to the drive motor 28. The current sensor 31 can be any conventional current sensor such as, without limitation, a shunt resistor, Hall effect sensor, or other current-measuring component. Although illustrated as a single component, the current sensor 31 can include multiple current-measuring components. For example, the current sensor 31 can include one current-measuring component for the first winding 51 and a second current measuring component for the second winding 52. The current sensor 31 can be electrically coupled to the controller 42.

Additionally, or alternatively, in non-limiting aspects, the set of sensors 30 can include a voltage sensor 32 electrically coupled to the drive motor 28. The voltage sensor 32 can be configured to generate a signal 32*a* indicative of the voltage from the electrical power source 39 across the drive motor 28. The voltage sensor 32 can be any conventional voltage sensor. Although illustrated as a single component, the voltage sensor 32 can include multiple voltage-measuring components. For example, the voltage sensor 32 can include one voltage-measuring component for the first winding 51 and a second voltage measuring component for the second winding 52. The voltage sensor 32 can be electrically coupled to the controller 42.

Additionally, or alternatively, in non-limiting aspects, the set of sensors 30 can also include a load sensor 33 configured to generate signals representative of the laundry load 11 (e.g., an amount of laundry and water 35 loaded inside of the drum 18). The load sensor 33 can comprise a physical displacement sensor attached to the drum 18. The weight of the load can cause the drum 18 to move down slightly. This displacement can be proportional to the weight of the laundry load 11. In other aspects, the load sensor 33 can be integrated in other components of the laundry treating appliance 10 or can be software based. For example, the load sensor 33 can measure a water level in the drum 18 or can measure a motor torque of the drive motor 28 to determine the weight of the laundry load 11. The load sensor 33 can also be electrically coupled to the controller 42.

Although the illustrated aspect includes the discrete current sensor 31, voltage sensor 32, and load sensor 33, in some embodiments, such sensors may be incorporated in other components of the laundry treating appliance 10. In particular, in some embodiments, the drive motor 28 may be used to perform the functions of the current sensor 31, voltage sensor 32, and load sensor 33. For example, in some aspects, a dynamic measurement of the drive motor 28 can be used by the controller 42 to determine the mass of the laundry load 11. For example, the power consumed by the drive motor 28 can be used to estimate the mass of the laundry load 11. As another example, as the laundry load 11 is rotating, the drum 18 or clothes mover 20 can be accelerated or decelerated by the drive motor 28. The torque of the drive motor 28 can be determined based on current consumption, and given the torque and acceleration, the mass of the laundry load 11 can be determined.

The CPU 44 may be any type of device capable of executing software or firmware, such as a microcontroller, microprocessor, digital signal processor, or the like. For example, it is contemplated that the controller 42 can be a microprocessor-based controller that implements control software and sends/receives one or more electrical signals to/from each of the various working components to effect control software.

The memory 46 can be embodied as one or more non-transitory, machine-readable media. The memory 46 can be configured to store, amongst other things, instructions in the form of, for example, a software routine (or routines) which, when executed by the CPU 44, allows the controller 42 to control operation of the laundry treating appliance 10. The memory 46 can be used for storing the control software that is executed by the CPU 44 in completing a cycle of operation using the laundry treating appliance 10 and any additional software. For example, the memory 46 can store a set of executable instructions including at least one user-selectable cycle of operation. The memory 46 can also be used to store information, such as a database or table, and to store data received from one or more components of the laundry treating appliance 10 that can be communicably coupled with the controller 42. The database or table can be used to store the various operating parameters for the one or more cycles of operation, including factory default values for the operating parameters and any adjustments to them by the control assembly or by user input. For example, in non-limiting aspects, the memory 46 can store the determined values of the respective parameters 60. Additionally, in non-limiting aspects, the memory 46 can further store a set of predetermined threshold values 63. Furthermore, as will be described in more detail herein, the memory 46 can store a set of predefined drive motor actuation sequences 80. In non-limiting aspects, each predefined drive motor actuation sequence 80 can define a predefined sequence of selectively and sequentially providing power and cutting off power to the drive motor 28 for predetermined respective durations. For example, in non-limiting aspects, each drive motor actuation sequence 80 can define a first power cycle 61, a second power cycle 62, a third power cycle 71, and a fourth power cycle 72. In non-limiting aspects, the first power cycle 61 can comprise a respective first ON period 65 followed by a first OFF period 65, the second power cycle 62 can comprise a respective second ON period 67 followed by second OFF period 68, the third power cycle 71 can comprise a respective third ON period 75 followed by a third OFF period 76, the fourth power cycle 72 can comprise a respective fourth ON period 77 followed by fourth OFF period 78.

In non-limiting aspects, the analog interface circuit 48 can convert converts output signals (e.g., from the user interface 14) into signals which are suitable for presentation to an input of the CPU 44. In particular, the analog interface circuit 48, by use of an analog-to-digital (A/D) converter (not shown) or the like, converts analog signals into digital signals for use by the CPU 44. It should be appreciated that the A/D converter may be embodied as a discrete device or number of devices, or may be integrated into the CPU 44.

Similarly, the analog interface circuit 48 can convert signals from the CPU 44 into output signals which are suitable for presentation to the electrically-controlled components associated with the laundry treating appliance 10. In particular, the analog interface circuit 48, by use of a digital-to-analog (D/A) converter (not shown) or the like, converts the digital signals generated by the CPU 44 into analog signals for use by the electronically-controlled components associated with the laundry treating appliance 10. It should be appreciated that, similar to the A/D converter described above, the D/A converter may be embodied as a discrete device or number of devices, or may be integrated into the CPU 44. It should also be appreciated that if any electronically-controlled component associated with the laundry treating appliance 10 operates on a digital input signal, the analog interface circuit 48 may be bypassed.

In operation, the controller 42 can selectively control the operation of the first switch 53 and the second switch 54 to provide the AC voltage from the electrical power source 39 to energize the first winding 51 and second winding 52 of the drive motor 28. The first winding 51 and second winding 52 can be arranged such that when energized, the first winding 51 causes a rotation of the drive motor 28 in the first direction (e.g., clockwise), and the second winding 52 will cause a rotation of the drive motor 28 in the second direction (e.g., counter-clockwise). In non-limiting aspects, the controller 42 can selectively control the operation of the first switch 53 and the second switch 54 based on a selected predefined drive motor actuation sequence 80 stored in the memory 46. In non-limiting aspects, the controller 42 can select the predefined drive motor actuation sequence 80 from the set of predefined drive motor actuation sequences 69 based on a comparison of the value of at least one sensed or measured parameter 60 with a predetermined respective threshold value 69 stored in the memory 46.

In accordance with the selected drive motor actuation sequence 80, the controller 42 can trigger a rotation of the drive motor 28 in the first direction for the first power cycle 61 and second power cycle 62. If desired, in accordance with the selected drive motor actuation sequence 80, the controller 42 can further trigger a rotation of the drive motor 28 in the second direction for the third power cycle 71 and fourth power cycle 72.

In non-limiting aspects, the first power cycle 61 can comprise the first ON period 65 having a predetermined first duration, followed by the first OFF period 66 having a predetermined second duration. The second power cycle 62 can comprise the second ON period 67 having a predetermined third duration, followed by the second OFF period 68 having a predetermined fourth duration. The third power cycle 71 can comprise the third ON period 75 having a predetermined fifth duration, followed by the third OFF period 76 having a predetermined sixth duration. The fourth power cycle 72 can comprise the fourth ON period 77 having a predetermined seventh duration, followed by the fourth OFF period 78 having a predetermined eighth duration.

In non-limiting aspects, controller 42 can trigger each of the first and second ON periods 65, 67 by providing the gate signal 57 to the first triac 53 to switch the first triac 53 to the ON or conducting state. The controller 42 can trigger each of the first and second OFF periods by ceasing or cutting off the gate signal 57 to the first triac 53 to thereby switch the first triac 53 to the OFF or non-conducting state. Similarly, controller 42 can trigger each of the the third and fourth ON periods 75, 77 by providing the gate signal 57 to the second triac 54 to switch the second triac 54 to the ON or conducting state. The controller 42 can trigger each of the third and fourth OFF periods 76, 78 by ceasing or cutting off the gate signal 57 to the second triac 54 to thereby switch the second triac 54 to the OFF or non-conducting state. For each of the first, second, third and fourth ON periods 65, 67, 75, 77, the gate signal 57 can be provided to the respective first triac 53 or second triac 54 at a predetermined time (or phase angle) after the start of each half-cycle of the AC voltage waveform. For example, the respective gate signal 57 can be provided to the first triac 53 or second triac 54 at a zero cross of the AC voltage waveform.

In other non-limiting aspects, other types of bidirectional switching devices may be used in place of the first triac 53 and second triac 54, for instance mechanical switches or relays. However, the use of triacs allows relatively precise control at the point (e.g. phase angle) at which the first winding 51 and second winding 52 of the drive motor 28 are energized.

Figure 5A:
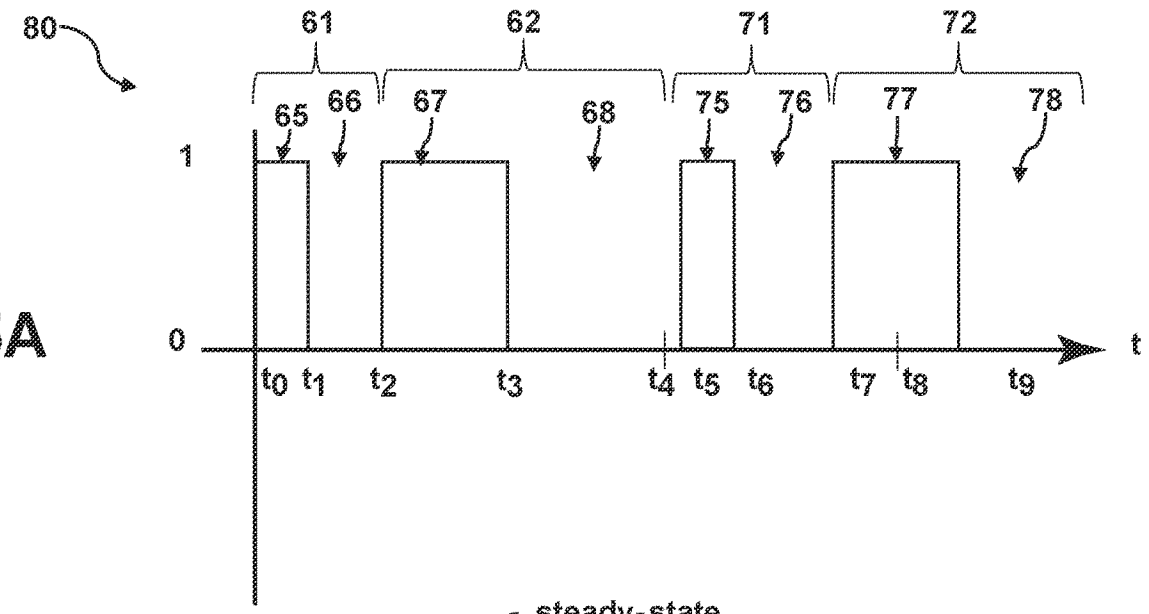
FIG. 5A illustrates a drive motor actuation sequence with respect to time in accordance with a non-limiting aspect of the present disclosure.

By way of illustration, FIG. 5A depicts an instance of a particular drive motor actuation sequence 80 in accordance with a non-limiting aspect. The execution of the drive motor actuation sequence 80 is depicted graphically with respect to time (t) for an instance of the drive motor 28 causing an oscillating operation the drive motor 28. In accordance with the particular drive motor actuation sequence 80, the controller 42 can sequentially trigger the first, second, third and fourth power cycles 61, 62, 71, 72.

As illustrated in FIG. 5A, the first triac 53, (shown in FIG. 4) can be triggered (at $t=t_0$) via the gate signal 57 from the controller 42 to transition from the OFF state to the ON state. In the ON state, the first triac 53 provides AC power to the first winding 51 during the first ON period 65 to cause the rotation of the drive motor 28 in the first direction. After the predetermined first duration (e.g., 70 milliseconds), the gate signal 57 to the first triac 53 is cut off (at $t=t_1$), transitioning the first triac 53 from the ON state to the OFF state, thereby deenergizing the drive motor 28 for the first OFF period 65. Next, after the predetermined second duration (e.g., 20 milliseconds) defined by the drive motor actuation sequence 80, the first triac 53, can be triggered (at $t=t_2$) via the gate signal 57 from the controller 42 to transition from the OFF state back to the ON state. In the ON state, the first triac 53 again provides AC power to the first winding 51 during the second ON period 67 to cause the continued rotation of the drive motor 28 in the first direction. After the predetermined third duration (e.g., 80 milliseconds), the gate signal to the first triac 53 is cut off (at $t=t_3$), to begin the second OFF period 68 for a predetermined fourth duration (e.g. 30 milliseconds).

To begin the rotation of the drive motor 28 in the second direction, the second triac 54, (shown in FIG. 4) can be triggered (at $t=t_5$) via the gate signal 57 from the controller 42 to transition from the OFF state to the ON state. In the ON state, the second triac 54 provides AC power to the second winding 52 during the second ON period 75 to cause a rotation of the drive motor 28 in the second direction. After the predetermined fifth duration (e.g., 80 milliseconds), the gate signal 57 to the second triac 54 is cut off (at $t=t_6$), transitioning the second triac 54 from the ON state to the OFF state, thereby deenergizing the drive motor 28 for the second OFF period 76. Next, after the predetermined sixth duration (e.g., 20 milliseconds) defined by the drive motor actuation sequence 80, the second triac 54, can be triggered (at $t=t_7$) via the gate signal 57 from the controller 42 to transition from the OFF state back to the "ON" state. In the ON state, the second triac 54 again provides AC power to the second winding 54 for the fourth ON period 77 to cause the continued rotation of the drive motor 28 in the second direction. After the predetermined seventh duration (e.g., 100 milliseconds), the gate signal 57 to the second triac 54 is cut off (at $t=t_9$), to begin the fourth OFF period 78 for a predetermined eighth duration (e.g. 720 milliseconds).

In some aspects the predefined first and third durations of the first ON period 65 and second ON period 67, respectively, can be equal. However, other aspects are not so limited. In some non-limiting aspects, the predefined first duration of the first ON period 65 and the predefined third duration of the second ON period 67 are not equal. In various non-limiting aspects, the predefined first duration of the first ON period 65 and the predefined second duration of the first OFF period 65 are not equal. For example, in some aspects the predetermined second duration of the first OFF period 66 can be greater than the predetermined first duration of the first ON period 65. In some aspects, the predetermined fourth duration of the second OFF period 68 can be greater than the predetermined third duration of the second ON period 67. Furthermore, in various non-limiting aspects, the predefined third duration of the second ON period 67 and the predefined fourth duration of the second OFF period 68 are unequal.

In some aspects the predefined durations of the third ON period 75 and second ON period 77 can be equal. However, other aspects are not so limited. In some non-limiting aspects, the predefined duration of the third ON period 75 and the predefined duration of the fourth ON period 77 are not equal. In various non-limiting aspects, the predefined duration of the third ON period 75 and the predefined duration of the third OFF period 76 are not equal. For example, in some aspects the predetermined duration of the third OFF period 76 can be greater than the predetermined duration of the third ON period 75. In some aspects, the predetermined duration of the fourth OFF period 78 can be greater than the predetermined duration of the fourth ON period 77. Furthermore, in various non-limiting aspects, the predefined duration of the fourth ON period 77 and the predefined duration of the fourth OFF period 78 are unequal.

Figure 5B:
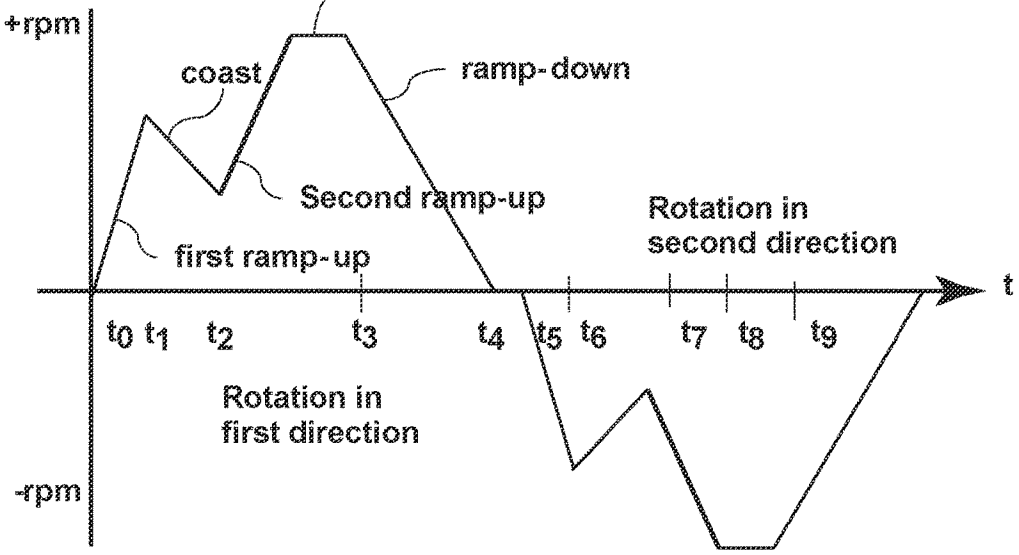
FIG. 5B illustrates a velocity profile of a drive motor having the energization sequence of FIG. 5A, in accordance with a non-limiting aspect of the present disclosure.

By way of further illustration, FIG. 5B, depicts a drive motor 28 velocity profile with respect to time (t) for a non-limiting aspect, based on the drive motor actuation sequence 80 depicted in FIG. 5A. As shown, when the controller 42 triggers the first triac 53 (at $t=t_0$) to energize the first winding 51, the drive motor 28, starting from an initial velocity of zero rpm, begins accelerating in the first direction during the first ON period 65. In this sense, the first ON period 65 can be referred to as a first velocity ramp-up phase for the drive motor 28. After the predetermined first duration (e.g., 70 milliseconds), the gate signal 57 to the first triac 53 is cut off (at $t=t_1$) thereby deenergizing the drive motor 28 to begin the first OFF period 66. It will be appreciated that although the AC power to the drive motor 28 is cut off, the drive motor 28 will continue to rotate in the first direction due to inertia (i.e., coast). In this sense, the first OFF period 66 can be referred to as a first coasting phase of the drive motor 28. In non-limiting aspects, the predetermined drive motor actuation sequence 80 can be configured to allow the drive motor 28 velocity to decrease during the first coasting phase by an amount that is imperceptible to a human user, prior to initiating the second power cycle 62. Next, after the predetermined second duration (e.g., 20 milliseconds) defined by the drive motor actuation sequence 80, the first triac 53, can be triggered (at $t=t_2$) to transition from the OFF state back to the ON state to again energize the first winding 51 during the second ON period 67 to again cause an acceleration of the drive motor 28 in the first direction until a desired predetermined velocity is reached.

The second ON period 67 can continue with the drive motor 28 rotating at a fixed velocity. In this sense, the second ON period 65 can be referred to as a second velocity ramp-up and a first steady-state phase for the drive motor 28. As can be seen, in aspects, the selected drive motor velocity profile 69 can enable bringing the drive motor up to a steady-state velocity in the first direction using a pair of sequentially triggered ON periods separated by an OFF period. Once the drive motor 28 reaches the predetermined desired velocity, it continues to rotate in the first direction at the predetermined constant velocity during the steady-state phase. After the predetermined third duration, the drive motor 28 is deenergized. The drive motor 28 will continue to rotate in the first direction due to inertia, eventually slowing to zero rpm. In this sense, the second OFF period 68 can be referred to as a second coasting or ramp-down phase of the drive motor 28. The duration of the second ramp-down phase will vary at least in part with the inertia of the drive motor 28.

As further shown in FIG. 5B, when the controller triggers the second triac 54 at $t=t_5$ to energize the drive motor 28 to rotate in the second direction, the drive motor 28, starting from an initial velocity of zero rpm, begins accelerating in the second direction during the third ON period 75. In this sense, the third ON period 75 can be referred to as the third velocity ramp-up phase of the drive motor 28. After the predetermined fifth duration (e.g., 80 milliseconds), the gate signal 57 to the second triac 54 is cut off (at $t=t_6$) thereby deenergizing the drive motor 28, the drive motor 28 will continue to rotate in the second direction due to inertia. In this sense, the second OFF period 66 can be referred to as the third coasting phase of the drive motor 28. The predetermined drive motor actuation sequence 80 can be configured to allow the drive motor 28 velocity to decrease during the third coasting phase by an amount that is imperceptible to a human user, prior to initiating the fourth power cycle 72. Next, after the predetermined sixth duration (e.g., 20 milliseconds) defined by the drive motor actuation sequence 80, the second triac 54, can be triggered (at $t=t_7$) to transition from the "OFF" state back to the "ON" state to again energize the second winding 52 during the fourth ON period 77 to again cause an acceleration of the drive motor 28 in the second direction until a desired predetermined velocity is reached. As can be seen, in aspects, the selected drive motor velocity profile 69 enables bringing the drive motor 28 up to a steady-state velocity in the second direction using a pair of sequentially triggered ON periods separated by an OFF period.

The fourth ON period 77 can continue with the drive motor 28 rotating at a fixed velocity. In this sense, the fourth ON period 75 can be referred to as a fourth velocity ramp-up and second steady-state velocity phase of the drive motor 28. Once the drive motor 28 reaches the predetermined desired velocity, it continues to rotate in the second direction at the predetermined constant velocity during the second steady-state phase. After the predetermined seventh duration, the drive motor 28 is deenergized, but will continue to rotate in the second direction due to inertia, eventually slowing to zero rpm. In this sense, the fourth OFF period 78 can be referred to as a fourth velocity coast or ramp-down phase the drive motor 28. The duration of the fourth ramp-down phase will vary at least in part with the inertia of the drive motor.

Figure 6:
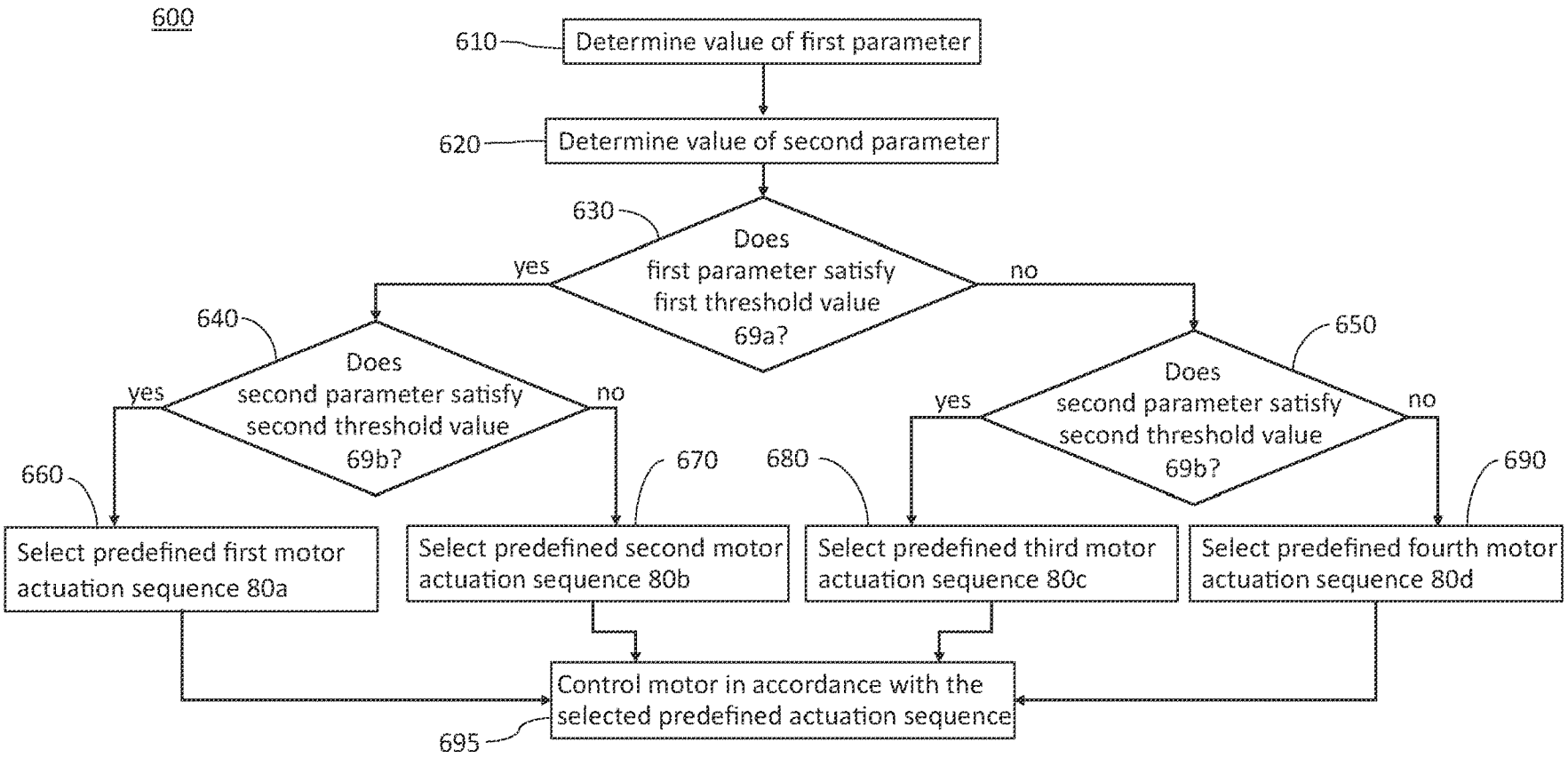
FIG. 6 depicts a flow chart of a method of controlling a laundry treating appliance in accordance with a non-limiting aspect of the present disclosure.

FIG. 6 depicts a flow chart of a non-limiting aspect of a method 600 of controlling a laundry treating appliance 10. In non-limiting aspects, the controller 42 can determine, at step 610, a value of a first parameter 63 associated with the laundry treating appliance 10 based on one or more signals 30*a* received from at least one sensor 30. In one non-limiting aspect, the first parameter 63 can be associated with a driving force acting on the drive motor 28, such as a voltage across the first winding 51. In non-limiting aspects, the controller 42 can determine, at step 620, a value of a second parameter 64 associated with the laundry treating appliance 10 operation. The controller 42 can determine the value of the second parameter 64 based on signals 30*a* received from at least one sensor 30. In at least one non-limiting aspect, the second parameter 64 can be associated with a braking or retarding force acting on the drive motor 28, such as a load (e.g., aa weight of the laundry load 11). In non-limiting aspects the first parameter 63 and second parameter 64 can be associated with or cooperatively indicative of an inertia of the drive motor 28. The controller 42 can be further configured to compare, at step 630, the determined value of the first parameter 63 with a corresponding respective first threshold value 69*a*. For example, in one particular non-limiting instance, the first threshold value 69*a* can include a predetermined average AC voltage (e.g., 122 volts). The first threshold value 69*a* can be stored in the memory 46.

In the event the controller 42 determines that the value of the first parameter 63 satisfies the first threshold value 69*a*, the controller 42 can then, at step 640, compare the determined value of the second parameter 64 with a corresponding respective second threshold value 69*b*. For example, in one particular non-limiting instance, the second threshold value 69*b* can include a predetermined water volume (e.g., 3 gallons). The corresponding respective second threshold value 69 can be stored in the memory 46. In the event the controller 42 determines that the value of the second parameter 64 satisfies the second threshold value 69*b*, the controller 42 can then, at step 660, select a predefined first motor actuation sequence 80*a* from memory based on the determination. Conversely, in the event the controller 42 determines that the value of the second parameter 64 does not satisfy the second threshold value 69*b*, the controller 42 can then, at step 670, select a predefined second motor actuation sequence 80*b* from memory 46 based on the determination.

In the event the controller 42 determines that the value of the first parameter 63 does not satisfy the first threshold value 69*a*, the controller 42 can then, at step 650, compare the determined value of the second parameter 64 with the corresponding respective second threshold value 69*b* in the memory 46. In the event the controller 42 determines that the value of the second parameter 64 satisfies the second threshold value 69*b*, the controller 42 can then, at step 680, select a predefined third motor actuation sequence 80*c* from memory 46 based on the determination. Conversely, in the event the controller 42 determines that the value of the second parameter 64 does not satisfy the second threshold value 69*b*, the controller 42 can then, at step 690, select a predefined fourth motor actuation sequence 80*d* from memory 46 based on the determination.

Based on the selected predefined drive motor actuation sequence 80*a*-80*d*, the controller 42 can then, at step 695, selectively operate the drive motor 28. For example, in non-limiting aspects, the controller 42 can selectively operate the drive motor 28 by sequentially triggering one of the first switch 53 or second switch 54 to provide the first and second power cycle 61, 62, in accordance with the selected predefined drive motor actuation sequence 80. Each drive motor actuation sequence 80 can define a respective first power cycle 61 and a second power cycle 62. In non-limiting aspects, the first power cycle 61 can comprise a respective first ON period 65 followed by a first OFF period 65, and the second power cycle 62 can comprise a respective second ON period 67 followed by second OFF period 68.

While operation of the disclosed aspects with respect to controlling the operation of the drive motor 28 to rotate in a first direction based on a selected drive motor actuation sequence 80 is described herein for ease of description and understanding, as including the first power cycle 61 and the second power cycle 62, it will be appreciated that other aspects are not so limited. It is contemplated that in other aspects the drive motor actuation sequence 80 can include any number of power cycles in addition to the first power cycle 61 and the second power cycle 62, having any desired respective duration, without departing from the disclosure herein. Furthermore, while operation of the disclosed aspects with respect to controlling the operation of the drive motor 28 to rotate in a second direction based on a selected drive motor actuation sequence 80 is described herein for ease of description and understanding, as including the third power cycle 71 and the fourth power cycle 72, it will be appreciated that other aspects are not so limited. It is contemplated that in other aspects the drive motor actuation sequence 80 can include any number of pulses in addition to the third power cycle 71 and the fourth power cycle 72, having any desired respective duration, without departing from the disclosure herein.

This written description uses examples to disclose aspects of the disclosure, including the best mode, and also to enable any person skilled in the art to practice aspects of the disclosure, including making and using any devices or systems and performing any incorporated methods. While aspects of the disclosure have been specifically described in connection with certain specific details thereof, it is to be understood that this is by way of illustration and not of limitation. Reasonable variation and modification are possible within the scope of the forgoing disclosure and drawings without departing from the spirit of the disclosure, which is defined in the appended claims.

What is claimed is:

1. A laundry treating appliance comprising:

a drum at least partially defining a treating chamber for receiving a laundry load;

a clothes mover disposed in the drum rotatably coupled to a drive motor; and a controller including a memory, communicatively coupled to the drive motor to selectively control an operation thereof, the controller configured to:

determine a first value of a first parameter and a second value of a second parameter associated with the laundry treating appliance;

compare the first value and the second value with a predetermined respective threshold value; and, based on the comparing:

select a drive motor actuation sequence comprising a first power cycle and a second power cycle, the first power cycle comprising a first acceleration phase and a first coast phase, and the second power cycle comprising a second acceleration phase, a steady-state velocity phase, and a second coast phase, wherein the first acceleration phase includes providing electrical power to a first winding of the drive motor for a first duration, the first coast phase includes cutting off the electrical power to the first winding for a second duration, the steady state velocity phase includes providing electrical power to the first winding for a third duration, and the second coast phase includes cutting off electrical power to the first winding for fourth duration; and control a speed of a rotation of the clothes mover in a first direction about a vertical axis by triggering the first power cycle and the second power cycle.

2. The laundry treating appliance of claim 1, wherein the first duration and the second duration are not equal.

3. The laundry treating appliance of claim 1, wherein the second duration is greater than the first duration.

4. The laundry treating appliance of claim 1, further comprising a set of sensors, the set of sensors configured to provide a respective signal to the controller indicative of the first value of the first parameter and the second value of the second parameter.

5. The laundry treating appliance of claim 1, wherein the first parameter is a voltage across the first winding, and the second parameter is an amount of water in the laundry load.

6. The laundry treating appliance of claim 1, wherein the first and second parameters are cooperatively indicative of an inertia of the drive motor.

7. The laundry treating appliance of claim 1, further comprising a first switch electrically coupled in series between a power source and the first winding, the first switch communicatively coupled to the controller; and wherein the controller is configured to selectively provide a respective gate signal to the first switch to trigger the first acceleration phase and the second acceleration phase.

8. The laundry treating appliance of claim 7, wherein the controller is configured to selectively cut off the respective gate signal to the first switch to trigger the first coast phase and second coast phase.

9. The laundry treating appliance of claim 1, wherein the drive motor actuation sequence further comprises:

a third power cycle and a fourth power cycle, the third power cycle comprising a third acceleration phase and a third coast phase, and the fourth power cycle comprising a fourth acceleration phase, a second steady-state velocity phase, and a fourth coast phase, and wherein the third acceleration phase includes providing electrical power to a second winding of the drive motor for a fifth duration, the third coast phase includes cutting off the electrical power to the first winding for a sixth duration, the second steady state velocity phase includes providing electrical power to the first winding for a seventh duration, and wherein the fourth coast phase includes cutting off electrical power to the second winding for a respective eighth duration; and wherein the controller is further configured to:

control a speed of rotation of the clothes mover in a second direction about the vertical axis, by triggering the third power cycle and the fourth power cycle.

10. The laundry treating appliance of claim 9, wherein the second direction is opposite the first direction.

* * * * *